United States Patent [19]

Calder et al.

[11] 4,054,751

[45] Oct. 18, 1977

[54] MASKING NOISE GENERATOR

[75] Inventors: George Donald Calder, Glen Ridge; John Duda, Dumont; John Fatovic, Palisades Park, all of N.J.

[73] Assignee: CDF Industries, Inc., Palisades Park, N.J.

[21] Appl. No.: 662,522

[22] Filed: Mar. 1, 1976

[51] Int. Cl.[2] ..... H04R 3/00

[52] U.S. Cl. ..... 179/1.5 M; 179/1 AA; 179/1 P; 331/78

[58] Field of Search ..... 179/1.5 M, 1.5 R, 1 AA, 179/1 P; 331/78

[56] References Cited

U.S. PATENT DOCUMENTS

| | | | |
|---|---|---|---|
| 3,213,199 | 10/1965 | Snow | 179/1.5 M |
| 3,567,863 | 3/1971 | Morrissey | 179/1 AA |
| 3,614,399 | 10/1971 | Linz | 331/78 |
| 3,681,708 | 8/1972 | Olmstead | 331/78 |
| 3,885,139 | 5/1975 | Hurd | 331/78 |
| 3,980,827 | 9/1976 | Sepmeyer et al. | 179/1 P |
| 4,024,535 | 5/1977 | Goldstein | 179/1 AA |

FOREIGN PATENT DOCUMENTS

| | | | |
|---|---|---|---|
| 1,420,201 | 1/1976 | United Kingdom | 179/1.5 M |

OTHER PUBLICATIONS

"Speech Privacy in Buildings", Cavanaugh, *Journal of the Acoustical Society of America*, vol. 34, No. 4, Apr. 1962, pp. 475–492.

"A Low Frequency Pseudo-Random Noise Generator", Kramer, *Electronic Engineering*, July 1965, pp. 465–467.

*A Hybrid Analog-Digital Pseudo Random Noise Generator", Hampton, Proceedings-Spring Joint Computer Conference*, 1964, pp. 287–297.

*Primary Examiner*—Howard A. Birmiel

*Attorney, Agent, or Firm*—Charles E. Baxley

[57] ABSTRACT

There is disclosed a masking noise generator which includes a digital means such as a shift register for generating noise signals wherein the output of the shift register is fed via a filtering means to a transducer means such as a speaker for converting the noise signals to acoustic waves.

3 Claims, 1 Drawing Figure

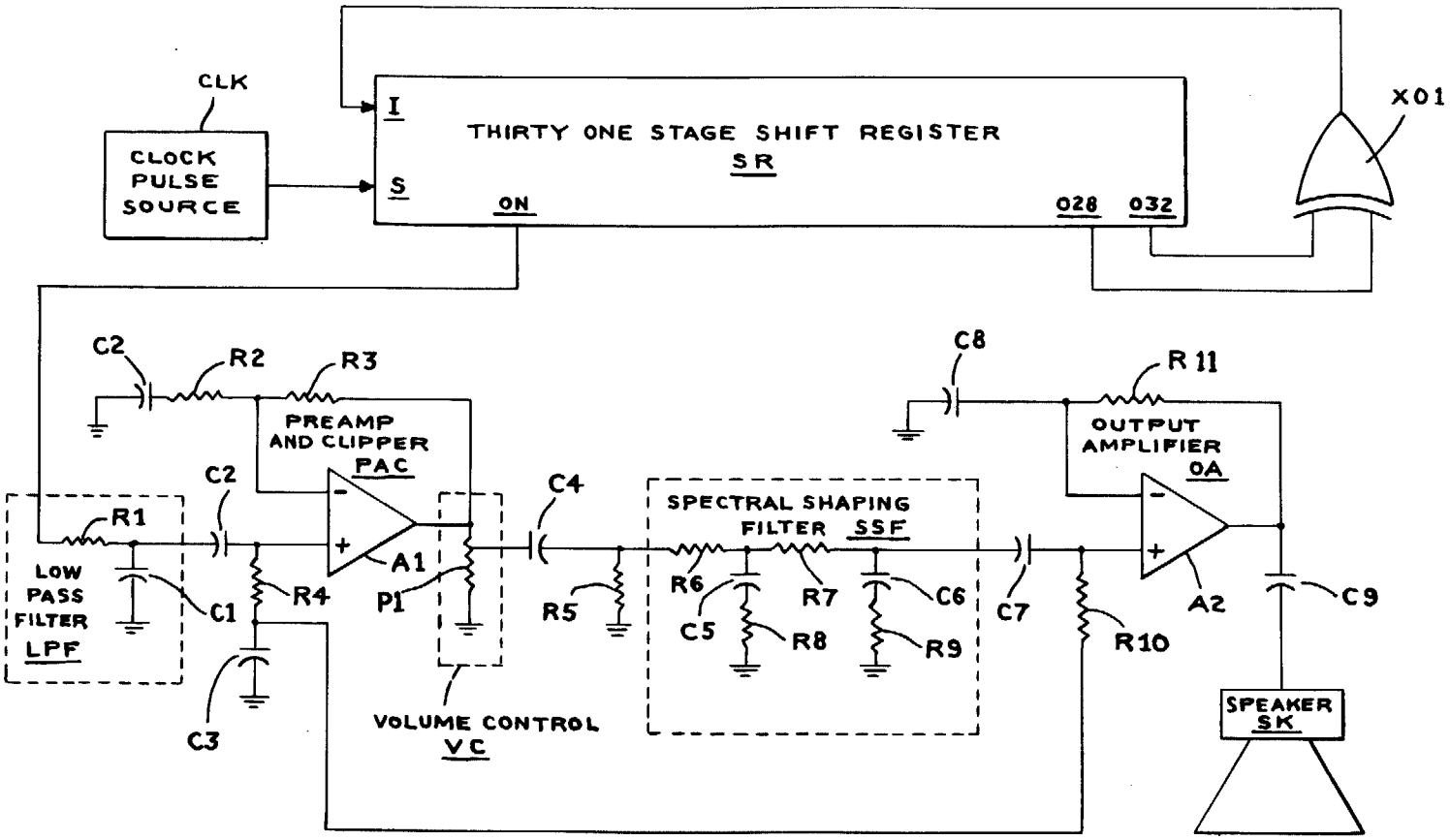
X01
THIRTY ONE STAGE SHIFT REGISTER
SR
I
S
ON
O28
O32
CLK
CLOCK PULSE SOURCE
R1
R2
R3
R4
R5
R6
R7
R8
R9
R10
R11
C1
C2
C3
C4
C5
C6
C7
C8
C9
A1
A2
PREAMP AND CLIPPER PAC
OUTPUT AMPLIFIER OA
SPECTRAL SHAPING FILTER SSF
LOW PASS FILTER LPF
P1
VOLUME CONTROL VC
SPEAKER SK

MASKING NOISE GENERATOR

BACKGROUND OF THE INVENTION

This invention pertains to sound masking and more particularly to apparatus for digitally generating masking noise signals.

Modern day architectural design emphasizes open plan office landscaping wherein mobile partial height partitions are utilized to obtain maximum use and flexibility of the available space. From an acoustic point of view there is the unavoidable disadvantage associated with open plan landscaping in that there is no conversational privacy between work zones. Although the problem of reducing speech intelligibility is difficult, acoustic engineers have utilized combined techniques to successfully obtain a solution. Partial height barriers and high absorptive ceiling tiles used concurrently have a limited effectiveness. Therefore there is a need for an additional technique to achieve the required privacy.

Such a technique adds an unobtrusive steady background "masking noise" to the work area. In order for the background noise to be an effective masker it must meet several requirements. In particular it must be an electronically derived noise since such noise is inoffensive to the ear while at the same time providing the desired speech privacy to the masked zone. More specifically such noise must be a steady and continuous broadband noise having a selected frequency spectrum shape and controllable volume. These criteria negate a random approach such as relying on normal office activities, air conditioning, music and the like to properly achieve speech unintelligibility. Hence, currently the utilization of electronic noise fed into an array of speakers has become an integral consideration of current office design.

Heretofore electronic noise was generated by exploiting or amplifying the inherent thermal noise in solid state devices such as diodes and transistors. However, this type of noise generation has several drawbacks. In particular there is an output sound instability due to sporadic shot noise in the solid state devices. Secondly semiconductor devices have characteristics which change over long periods of time. Accordingly, the generated noise output quality and volume would also change. Thirdly, the high amplification requirements for amplifying the thermal noise make any system utilizing this technique subject to stray pickup of radiation fields and hum. In addition, the noise generation characteristics of a solid state device are normally uncontrollable. Therefore, high volume production is restricted since each noise generating semiconductor must be selected by preliminary tests. The uncontrollable parameters result in a low yield of usable units and consequently raise the costs of the system. Furthermore, after even the preliminary selection of the semiconductors, each unit must be individually adjusted for output level and sound quality. Accordingly, special variable resistance networks must be built into each system to permit such adjustment after assembly. Testingand adjustment time with trained personnel furthermore increases the cost of the system. Finally, using noise generating solid state devices restricts interchangeability without subsequent adjustment by trained and highly skilled personnel.

SUMMARY OF THE INVENTION

It is accordingly a general object of the invention to provide improved apparatus for generating masking noises.

It is another object of the invention to provide such apparatus which does not suffer from the instabilities due to sporadic shot noise in solid state devices, as well as their variations in characteristics.

It is a further object of the invention to provide such apparatus which does not require the initial preselection of components before assembly nor the adjustment of components during and after assembly skilled personnel.

These and other objects are satisfied by apparatus for generating masking noises which comprises digital means for generating noise signals, filter means for filtering the noise signals and transducer means for converting the filtered noise signals to acoustic waves.

DESCRIPTION OF THE DRAWING

Other objects, the features and advantages of the invention will be apparent from the following detailed description when read with the accompanying drawing whose sole FIGURE shows a partial block-and-partial schematic diagram of apparatus according to a preferred embodiment of the invention.

DESCRIPTION OF THE PREFERRED EMBODIMENT

In the sole Figure there is shown a masking noise generating system comprising digital means for generating the noise signals, a filter means for filtering the noise signals and a transducer means for converting the filtered noise signals to acoustic waves.

In particular the digital means for generating the noise signals comprises a clock pulse source CLK, a 31-stage shift register SR and an exclusive-or circuit XO1. The 31-stage shift register has a shifting input S for receiving clock pulses from source CLK and bit input I which is fed from the output of the exclusive-or circuit XO1. The exclusive-or circuit has at least two inputs and which are preferably connected to the 28th and 31st stages of the shift register SR. These outputs are labelled 028 and 031.

It should be noted that at any given instant of time the 31 stages of the shift register SR store a 31-bit word which is a combination of binary ones (1's) and zeros (0's). It can be shown mathematically, when using a 31-stage shift register SR with two outputs feeding and exclusive-or circuit, that the possible number of variations of the 31-bit binary word exceed 2 billion and that these combinations cyclically repeat each other after a period of over 2 billion cycles. Hence, at any output of the shift register there will be transmitted binary ones and zeros or pulses and no pulses wherein the pattern repeats itself after over2 billion clock pulse times. The pulses of this pattern of pulse (1) and no pulse (b 0) actually represents pseudo random noise which approaches true random noise with an infinitesimally small error. In fact the error is one part in over 2 billion. Hence the random stream of pulses from say the output ON of the shift register SR can be considered as a noise signal.

This noise signal is fed to a filteringmeans to produce the noise in the desired spectrum. The filter means comprises a low pass filter LPF, the preamplifier and clipper PAC and the spectral shaping filter SSF. The low pass filter LPF comprising resistor R1 and C1 has its input connected to the output ON of shift register SR and its output connected to the input of preamplifier and clipper PAC. The output of the amplifier and clipper PAC is fed via a volume control VC and a coupling network to the spectral shaping filter SSF.

The purpose of the low pass filter LPF is to provide approximately 3db/octave attenuation for signals above 3500 Hz. The filter sharply attenuates the extreme high frequencies produced by the shift register switching. That is the transitions between the binary ones and zeros or the transitions between the high and low voltages pulse and no pulse stream. In addition the low pass filter LPF provides moderate attenuation in the high audio band frequencies, that is, above 3500 Hz, to aid in the spectral shaping. The low pass filter has a 3 db/octave roll off beginning at approximately 3120 Hz.

The preamplifier and clipper PAC comprises a conventional operational amplifier which is set to a desired clipping level. The object of the clipper is to operate in conjunction with the low pass filter to remove high amplitude, low frequency signals which produce an annoying remble in the generated noise. The volume control VC can be of a conventional potentiometer whose tap is connected via the coupling network comprising capacitor C4 and resistor R5 to the spectral shaping filter.

The spectral shaping filter SSF comprises a $\pi$ section having two legs. A first leg comprises capacitor C5 and resistor R8 connected in series; a second leg comprises capacitor C6 and resistor R9 connected in series; and a branch comprises resistor R7. The junction of capacitor C5 and R7 is connected via resistor R6 and the coupling network to the voltage control VC. The output of the spectral shaping filter is fed via coupling network C7 and resistor R10 to the input of output amplifier OA whose output is connected via coupling capacitor C9 to the speaker SK.

In operation the pulse no pulse pattern generated by shift register SR is low-pass filtered in low pass filter LPF to eliminate the high frequency transistions in the pulses. This signal is then amplified and clipped by clipper PAC and spectrally filtered by filter SSF before final audio amplification and transmission to speaker SK where the filtered signals are then converted to acoustic waves representing the masking noise.

The amplifiers PAC and OA are common-off-the-shelf items. A typical amplifier is amplifier LM377 available from National Semiconductor. The shift register can also be one of many conventional types, a typical one being Parts No. CD4006N of National Semiconductor. Since such an off-the-shelf shift register is an 18 stage register, two such registers must be connected in cascade with the last five stages of the second register being unused.

While only one embodiment of the invention has been shown and described in detail, there will now be obvious to those skilled in the art many modifications and variations satisfying many or all of the objects of the invention but which do not depart from the spirit thereof as defined by the appended claims.

We claim:

1. Apparatus for generating audible masking noise comprising: a multi-stage shift register having an input and at least two outputs connected to two different stages, an exclusive-or means having two inputs respectively connected to the outputs of said two stages and an output connected to the input of said shift register; means for generating shift pulses for shifting said shift register; a low-pass filter for passing signals only in the audio range, said low-pass filter having an input connected to one of the outputs of said multi-stage shift register and an output; a signal clipping amplifier means having an input connected to the output of said low-pass filter and an output; a spectral shaping filter having an input connected to the output of said signal clipping amplifier means and an output; and a loud speaker connected to the output of said spectral shaping filter.

2. The apparatus of claim 1 wherein said spectal shaping filter comprises a $\pi$-section with each leg thereof comprising a resistor and capacitor connected in series and a branch member comprising a resistor, and a further resistor connecting the input of said spectral shaping filter to the junction of one of said legs and said branch member.

3. The apparatus of claim 2 wherein said low-pass filter comprises a resistor connecting an output of said multistage shift register to the input of said signal clipping amplifier means and a capacitor connecting the input of said signal clipping amplifier means to ground.

* * * * *